US009644372B2

(12) United States Patent
Ichikawa et al.

(10) Patent No.: US 9,644,372 B2
(45) Date of Patent: May 9, 2017

(54) HIGH-STRENGTH H-BEAM STEEL EXHIBITING EXCELLENT LOW-TEMPERATURE TOUGHNESS AND METHOD OF MANUFACTURING SAME

(71) Applicant: Nippon Steel & Sumitomo Metal Corporation, Tokyo (JP)

(72) Inventors: Kazutoshi Ichikawa, Tokyo (JP); Teruyuki Wakatsuki, Tokyo (JP); Noriaki Onodera, Tokyo (JP); Kohichi Yamamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/359,620

(22) PCT Filed: Dec. 12, 2012

(86) PCT No.: PCT/JP2012/082254
§ 371 (c)(1),
(2) Date: May 21, 2014

(87) PCT Pub. No.: WO2013/089156
PCT Pub. Date: Jun. 20, 2013

(65) Prior Publication Data

US 2014/0301888 A1 Oct. 9, 2014

(30) Foreign Application Priority Data

Dec. 15, 2011 (JP) ..... 2011-274278

(51) Int. Cl.
*E04C 3/32* (2006.01)
*E04C 3/04* (2006.01)
(Continued)

(52) U.S. Cl.
CPC ..... *E04C 3/32* (2013.01); *B21B 1/088* (2013.01); *C21D 8/0205* (2013.01);
(Continued)

(58) Field of Classification Search
CPC . E04C 3/32; C21D 2201/05; C21D 2211/002; B21B 1/088; B21B 1/0883; B21B 1/0886
See application file for complete search history.

(56) References Cited

U.S. PATENT DOCUMENTS 6,066,212 A * 5/2000 Koo et al. ..... 148/336
6,440,235 B1 * 8/2002 Kimura ..... C21D 8/00 148/546
(Continued)

FOREIGN PATENT DOCUMENTS

JP 11-193440 7/1999
JP 2001-073069 3/2001
(Continued)

OTHER PUBLICATIONS

International Search Report dated Feb. 12, 2013 issued in corresponding PCT Application No. PCT/JP2012/082254 [with English Translation].

*Primary Examiner* — Scott Kastler
*Assistant Examiner* — Vanessa Luk
(74) *Attorney, Agent, or Firm* — Birch, Stewart, Kolasch & Birch, LLP

(57) ABSTRACT

This H-beam steel contains, in mass %, C, Si, Mn, Al, Ti, N, O, Nb, and B. The H-beam steel has composition in which the amount of Nb and the amount of B satisfy, in mass %, $0.070 \leq Nb+125B \leq 0.155$, and has a metal structure in which, in a microstructure, an area fraction of bainite is not less than 70%, a total of an area fraction of pearlite and an area fraction of cementite is not more than 15%, and the remainder is at least one of ferrite and island martensite. The
(Continued)

effective crystalline-grain size of the bainite is not more than 40 μm, and the thickness of a flange falls in a range of 12 to 40 mm.

6 Claims, 1 Drawing Sheet

(51) Int. Cl.

| | |
|---|---|
| ***C22C 38/00*** | (2006.01) |
| ***C22C 38/12*** | (2006.01) |
| ***B21B 1/088*** | (2006.01) |
| ***C22C 38/14*** | (2006.01) |
| ***C22C 38/58*** | (2006.01) |
| ***C22C 38/02*** | (2006.01) |
| ***C22C 38/04*** | (2006.01) |
| ***C21D 8/02*** | (2006.01) |
| ***C22C 38/06*** | (2006.01) |
| ***C22C 38/08*** | (2006.01) |
| ***C22C 38/16*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| *C21D 8/00* | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/32* (2013.01); *C22C 38/38* (2013.01); *C22C 38/58* (2013.01); *C21D 8/00* (2013.01); *C21D 2211/002* (2013.01); *C21D 2211/005* (2013.01); *C21D 2211/008* (2013.01); *E04C 2003/0404* (2013.01)

(56) References Cited

U.S. PATENT DOCUMENTS

| | | | | |
|---|---|---|---|---|
| 7,914,629 | B2 * | 3/2011 | Nakashima et al. | 148/336 |
| 8,039,118 | B2 * | 10/2011 | Hara | B23K 9/0282 138/142 |
| 2009/0020190 | A1 | 1/2009 | Okumura et al. | |
| 2010/0047107 | A1 * | 2/2010 | Yoshida et al. | 420/83 |
| 2010/0078097 | A1 | 4/2010 | Yoshida et al. | |

FOREIGN PATENT DOCUMENTS

| | | |
|---|---|---|
| JP | 2002-294391 | 10/2002 |
| JP | 2011-106006 | 6/2011 |
| JP | 2011-202209 | 10/2011 |
| WO | WO2007/091725 | 8/2007 |
| WO | WO2008/126910 | 10/2008 |
| WO | WO2009/123076 | 10/2009 |

* cited by examiner

HIGH-STRENGTH H-BEAM STEEL EXHIBITING EXCELLENT LOW-TEMPERATURE TOUGHNESS AND METHOD OF MANUFACTURING SAME

TECHNICAL FIELD

The present invention relates to a high-strength H-beam steel exhibiting low-temperature toughness used as a structure element of buildings used in a low-temperature environment, and a method of manufacturing this H-beam steel.

This application is a national stage application of International Application No. PCT/JP2012/082254, filed Dec. 12, 2012, which claims priority to Japanese Patent Application No. 2011-274278 filed in Japan on Dec. 15, 2011, each of which is incorporated by reference in its entirety.

BACKGROUND ART

In recent years, with the increase in the energy demand on a worldwide scale, there has been a rapid increase in demand for buildings such as structures of energy-related facilities in cold climate areas. These facilities include, for example, a floating production, storage and offloading system (FPSO), in other words, a facility that produces oil and gas at sea, stores the product in a tank within the facility, and directly offloads it to a transport tanker. H-beam steels used in building these structures are required to have excellent low-temperature toughness.

Conventionally, H-beam steels have been used in a general building structures, and H-beam steels having excellent toughness and fireproof have been proposed (see, for example, Patent Documents 1 to 3). For general building structures, Charpy absorbing energy at approximately 0° C. is required. On the other hand, for H-beam steels used in the energy-related facilities in cold climate areas, Charpy absorbing energy, for example, at −40° C. is required. Further, in order to rationally guarantee the low-temperature toughness, it is necessary to specify CTOD values at −10° C. in addition to the characteristics of Charpy impact tests.

The crack tip opening displacement (CTOD) test is one for evaluating fracture toughness of a structure containing imperfections. When bending stress is applied to a test piece having a crack while predetermined temperatures are maintained, the phenomenon of "unstable fracture" occurs in which a crack rapidly propagates. With this CTOD test, the crack tip opening displacement (CTOD value) immediately before this crack rapidly propagates is measured. Favorable correlation may not always exist between the CTOD value and the Charpy absorbing energy.

In particular, if H-beam steels are manufactured by applying hot rolling to blooms obtained through continuous casting, it is difficult to secure toughness through reduction in the size of crystalline grain. This is because the maximum thickness of the bloom that continuous-casting equipment can manufacture is limited, and hence the rolling reduction is insufficient. Further, if rolling is performed at high temperatures to obtain products with high dimensional accuracy, the thick flange portion has high rolling temperatures, which leads to a decrease in the rate of cooling. This causes a concern that, at the flange portion, crystalline grains coarsen and toughness deteriorates. Although structures having fine grains can be obtained by applying accelerated cooling after rolling finishes, an enormous cost is required to install such equipment.

RELATED ART DOCUMENT(S)

Patent Document

Patent Document 1: Japanese Unexamined Patent Application, First Publication No. H11-193440

Patent Document 2: PCT International Publication No. WO 2007-91725

Patent Document 3: PCT International Publication No. WO 2008-126910

DISCLOSURE OF THE INVENTION

Problems to be Solved by the Invention

An object of the present invention is to provide an H-beam steel having strength and low-temperature toughness applicable to structures in cold climate areas, and exhibiting excellent weldability, and a method of manufacturing the H-beam steel, more specifically, to provide an H-beam steel that can be manufactured without the need to install large cooling equipment, and a method of manufacturing the H-beam steel.

Means for Solving the Problem

The high-strength H-beam steel according to the present invention has low-temperature toughness improved by suppressing, as much as possible, the generation of carbides from which brittle fracture initiates to occur, and the method of manufacturing this H-beam steel is one that manufactures the H-beam steel without applying accelerated cooling after rolling finishes. The following are the main points of the present invention.

(1) The first aspect of the present invention provides an H-beam steel with a composition including, in mass %: C: 0.011 to 0.040%; Si: 0.06 to 0.50%; Mn: 0.80 to 1.98%; Al: 0.006 to 0.040%; Ti: 0.006 to 0.025%; N: 0.001 to 0.009%; O: 0.0003 to 0.0035%; Nb: 0.020 to 0.070%; B: 0.0003 to 0.0010%; P: limited to not more than 0.010%; and S: limited to not more than 0.005%, with a balance including Fe and inevitable impurities, wherein an amount of Nb and an amount of B satisfy, in mass %, Equation A described below, the H-beam steel has a metal structure in which, in a microstructure, an area fraction of bainite is not less than 70%, a total of an area fraction of pearlite and an area fraction of cementite is not more than 15%, and the remainder consists of at least one of ferrite and island martensite, an effective crystalline-grain size of the bainite is not more than 40 μm, and a thickness of a flange falls in a range of 12 to 40 mm.

$$0.070 \leq Nb + 125B \leq 0.155 \qquad \text{Equation A}$$

(2) In the H-beam steel according to (1) above, the composition may further include, in mass %, at least one of: V: not more than 0.10%; Cu: not more than 0.60%; Ni: not more than 0.55%; Mo: not more than 0.15%; and Cr: not more than 0.20%.

(3) In the H-beam steel according to (1) above, the composition may further include, in mass %, at least one of: Zr: not more than 0.01%; and Hf: not more than 0.01%.

(4) In the H-beam steel according to (1) above, the composition may further include, in mass %, at least one of: REM: not more than 0.01%; Ca: not more than 0.005%; and Mg: not more than 0.005%.

(5) In the H-beam steel according to (1) above, the composition may further include, in mass %, at least one of: V: not more than 0.10%; Cu: not more than 0.60%; Ni: not more than 0.55%; Mo: not more than 0.15%; Cr: not more than 0.20%; Zr: not more than 0.01%; Hf: not more than 0.01%; REM: not more than 0.01%; Ca: not more than 0.005%; and Mg: not more than 0.005%.

(6) In the H-beam steel according to (1) above, the amount of Nb and the amount of B satisfy, in mass %, Equation B described below.

$$0.070 \leq Nb+125B \leq 0.115 \quad \text{Equation B}$$

(7) The second aspect of the present invention includes a method of manufacturing an H-beam steel, in which, when a steel with the composition according to any one of (1) to (6) above is rolled, finishing rolling includes rolling performed for one or more passes at a surface temperature of a flange in a range of 770 to 870° C.

Effects of the Invention

According to the present invention, it is possible to manufacture the high-strength H-beam steel exhibiting low-temperature toughness without applying accelerated cooling after rolling finishes. This makes it possible to achieve a reduction in the manufacturing time, and significantly reduce the cost. Thus, reliability of large buildings can be enhanced without sacrificing cost efficiency, and hence, the present invention makes an extremely significant contribution to industries.

EMBODIMENTS OF THE INVENTION

Figure 1:
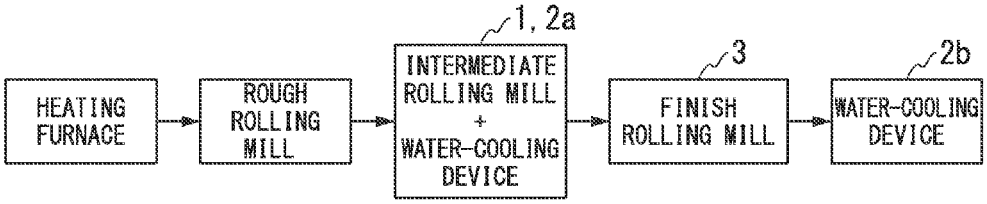
FIG. 1 is a diagram illustrating an example of a device of manufacturing an H-beam steel according to an embodiment of the present invention.

The present inventors paid attention to the fact that toughness significantly decreases because of a fracture mechanism starting from a structure including carbides such as pearlite and cementite and made a study of suppressing formation of carbides serving as the start point of brittle fracture with the aim of improving the low-temperature toughness. Then, the present inventors achieved improving the low-temperature toughness by reducing carbon in the steel to suppress formation of carbides, and adding an appropriate amount of alloying elements such as Nb and B to generate bainite necessary for securing strength.

In particular, in the present invention, the amount of Nb and the amount of B (mass %) are adjusted so as to satisfy Equation 1 given below in order to improve hardenability with the synergetic effects between Nb and B.

$$0.070 \leq Nb+125B \leq 0.155 \quad \text{Equation 1}$$

This makes it possible to reduce the amount of C to secure strength, suppress formation of carbides serving as the start point of fracture, and improve toughness. In the above-described equation, a weight is applied to B as a coefficient, by considering the effect of B, which significantly improves hardenability even if its amount is very small. The lower limit of Nb+125B is set to 0.070 or more, preferably to 0.075 or more to secure strength. The upper limit of Nb+125B is set to 0.155 or less, preferably 0.115 or less, more preferably less than 0.1 to secure toughness. Note that Table 1 shows chemical components of steels atop for which values of Nb+125B are adjusted so as to fall in the range of 0.058 to 0.170. Table 2 shows mechanical characteristics at a test-piece taking position A (described later) of H-beam steels a' to p' having a flange thickness of 25 mm and manufactured using the steels a top under conditions where a heating temperature is set to 1300° C. and a finishing rolling temperature is set to 850° C.

TABLE 1

| Steel | Components (mass %) (Balance: Fe and inevitable impurities) | | | | | | | | | | | Nb + |
|---|---|---|---|---|---|---|---|---|---|---|---|---|
| No. | C | Si | Mn | Al | Ti | N | O | P | S | Nb | B | 125B |
| a | 0.015 | 0.20 | 1.65 | 0.007 | 0.020 | 0.0036 | 0.0024 | 0.009 | 0.003 | 0.020 | 0.0003 | 0.058 |
| b | 0.014 | 0.22 | 1.66 | 0.007 | 0.021 | 0.0035 | 0.0025 | 0.009 | 0.003 | 0.024 | 0.0003 | 0.062 |
| c | 0.014 | 0.20 | 1.65 | 0.008 | 0.020 | 0.0036 | 0.0024 | 0.009 | 0.003 | 0.030 | 0.0003 | 0.068 |
| d | 0.015 | 0.21 | 1.64 | 0.007 | 0.020 | 0.0027 | 0.0022 | 0.008 | 0.003 | 0.036 | 0.0003 | 0.074 |
| e | 0.013 | 0.21 | 1.65 | 0.007 | 0.020 | 0.0030 | 0.0024 | 0.009 | 0.003 | 0.040 | 0.0004 | 0.090 |
| f | 0.015 | 0.20 | 1.65 | 0.007 | 0.022 | 0.0037 | 0.0021 | 0.009 | 0.002 | 0.046 | 0.0004 | 0.096 |
| g | 0.014 | 0.23 | 1.63 | 0.007 | 0.020 | 0.0036 | 0.0024 | 0.009 | 0.003 | 0.051 | 0.0004 | 0.101 |
| h | 0.015 | 0.20 | 1.65 | 0.006 | 0.020 | 0.0036 | 0.0024 | 0.009 | 0.003 | 0.055 | 0.0004 | 0.105 |
| i | 0.015 | 0.20 | 1.65 | 0.007 | 0.023 | 0.0038 | 0.0025 | 0.009 | 0.003 | 0.060 | 0.0005 | 0.123 |
| j | 0.013 | 0.19 | 1.66 | 0.007 | 0.020 | 0.0036 | 0.0024 | 0.009 | 0.003 | 0.066 | 0.0005 | 0.129 |
| k | 0.015 | 0.20 | 1.65 | 0.007 | 0.025 | 0.0035 | 0.0024 | 0.008 | 0.003 | 0.069 | 0.0005 | 0.132 |
| l | 0.015 | 0.20 | 1.65 | 0.007 | 0.020 | 0.0036 | 0.0024 | 0.009 | 0.003 | 0.075 | 0.0005 | 0.138 |
| m | 0.012 | 0.18 | 1.65 | 0.007 | 0.020 | 0.0036 | 0.0025 | 0.009 | 0.003 | 0.081 | 0.0006 | 0.156 |
| n | 0.015 | 0.20 | 1.65 | 0.009 | 0.020 | 0.0029 | 0.0024 | 0.009 | 0.003 | 0.085 | 0.0006 | 0.160 |
| o | 0.012 | 0.20 | 1.67 | 0.007 | 0.020 | 0.0035 | 0.0024 | 0.009 | 0.004 | 0.091 | 0.0006 | 0.166 |
| p | 0.015 | 0.20 | 1.65 | 0.008 | 0.023 | 0.0036 | 0.0023 | 0.009 | 0.003 | 0.095 | 0.0006 | 0.170 |

TABLE 2

| | Steel No. | YS (MPa) | TS (MPa) | vE-40 (J) | vE-50 (J) | CTOD value (mm) |
|---|---|---|---|---|---|---|
| H-beam steel a' | a | 346 | 461 | 51 | 20 | 0.10 |
| H-beam steel b' | b | 350 | 470 | 52 | 24 | 0.11 |
| H-beam steel c' | c | 351 | 483 | 55 | 23 | 0.13 |
| H-beam steel d' | d | 365 | 491 | 80 | 63 | 0.17 |
| H-beam steel e' | e | 365 | 495 | 244 | 110 | 0.18 |
| H-beam steel f' | f | 368 | 496 | 241 | 230 | 0.20 |
| H-beam steel g' | g | 376 | 505 | 255 | 244 | 0.22 |
| H-beam steel h' | h | 384 | 510 | 265 | 211 | 0.25 |
| H-beam steel i' | i | 383 | 520 | 230 | 198 | 0.21 |
| H-beam steel j' | j | 390 | 533 | 211 | 200 | 0.19 |
| H-beam steel k' | k | 400 | 532 | 191 | 185 | 0.19 |
| H-beam steel l' | l | 401 | 550 | 123 | 99 | 0.18 |

TABLE 2-continued

| | Steel No. | YS (MPa) | TS (MPa) | vE-40 (J) | vE-50 (J) | CTOD value (mm) |
|---|---|---|---|---|---|---|
| H-beam steel m' | m | 405 | 564 | 90 | 81 | 0.20 |
| H-beam steel n' | n | 412 | 585 | 41 | 25 | 0.08 |
| H-beam steel o' | o | 430 | 603 | 45 | 10 | 0.09 |
| H-beam steel p' | p | 438 | 618 | 47 | 20 | 0.10 |

Further, the present inventors found that, in order to obtain a fine-grained structure exhibiting favorable toughness, it is significantly effective to perform rolling while controlling temperatures of the surface of a flange. In the present invention, it is necessary to perform rolling for one or more passes in the finishing rolling with temperatures of the surface of a flange being not lower than 770° C. and not higher than 870° C.

Below, an H-beam steel according to an embodiment of the present invention made on the basis of the findings described above will be described.

First, components of the H-beam steel according to this embodiment will be described. Hereinafter, the symbol "%" indicating the amount of each component means "mass %" unless otherwise specified.

C: 0.011% to 0.040%

C is an element effective in strengthening steels, and the lower limit value of the amount of C is set to 0.011% or more, preferably to 0.12% or more, more preferably to 0.15% or more. However, if the amount of C exceeds 0.040%, carbides are generated, and the low-temperature toughness deteriorates. Thus, the upper limit of the amount of C is set to 0.040% or less, preferably to 0.35% or less. In order to further improve toughness and resistance to weld cracking of the base metal and HAZ, it is preferable to set the upper limit of the amount of C to 0.030% or less.

Si: 0.06% to 0.50%

Si is a deoxidizing element and contributes to improving strength. Thus, the lower limit of the amount of Si is set to 0.06% or more, preferably to 0.10% or more. On the other hand. Si is an element that facilitates formation of cementite, and the upper limit of the amount of Si is set to 0.50% or less, preferably to 0.45% or less. Further, in order to suppress formation of island martensite and further improve toughness of the base metal and welded portion, it is preferable to set the upper limit of the amount of Si to 0.40% or less.

Mn: 0.80% to 1.98%

Mn increases hardenability, and causes bainite to form to secure strength of the base material. Thus, the amount of Mn added is set to 0.80% or more, preferably to 0.90% or more. In order to further increase strength of the base metal, the amount of Mn is set preferably to 1.00% or more, more preferably to 1.30% or more. On the other hand, if the amount of Mn added exceeds 1.98%, toughness, resistance to cracking or other characteristics of the base material and the welded portion deteriorate. Thus, the upper limit of the amount of Mn is set to 1.98% or less, preferably to 1.95% or less. In order to secure toughness of the base metal, the upper limit of the amount of Mn is set preferably to 1.80% or less, more preferably to 1.60% or less.

Al: 0.006% to 0.040%

Al is a deoxidizing element, and the amount of Al added is set to 0.006% or more. The lower limit of the amount of Al is set preferably to 0.007% or more, more preferably to 0.015% or more, further more preferably to 0.020% or more. On the other hand, the upper limit of the amount of Al is limited to 0.040% or less in order to prevent coarsened oxide from forming. Further, reducing the amount of Al is also effective in suppressing formation of island martensite. Thus, it is preferable to set the upper limit of the amount of Al to 0.030% or less.

Ti: 0.006% to 0.025%

Ti is an important element in improving toughness of the base material. Ti forms fine Ti oxide or TiN, and contributes to reducing the size of crystalline grains. Thus, the amount of Ti added is set to 0.006% or more, preferably 0.008% or more. Further, in order to fix N with Ti and secure solute B to improve hardenability, it is preferable to set the amount of Ti added to 0.010% or more. On the other hand, if the amount of Ti exceeds 0.025%, coarsened TiN forms, and the toughness of a base metal deteriorates. Thus, the upper limit of the amount of Ti is set to 0.025% or less. Further, in order to suppress precipitation of TiC and suppress a reduction in toughness due to precipitation hardening, it is preferable to set the upper limit of the amount of Ti to 0.020% or less.

N: 0.001% to 0.009%

N reduces the size of a crystalline grain with fine TiN. Thus, the amount of N added is set to 0.001% or more. On the other hand, if the amount of N exceeds 0.009%, coarsened TiN forms, and the toughness deteriorates. Thus, the upper limit of the amount of N is set to 0.009% or less. Further, if the amount of N increases, the island martensite forms, possibly deteriorating toughness. Thus, it is preferable to set the amount of N to 0.006% or less.

O: 0.0003% to 0.0035%

O is an impurity, and suppresses formation of oxide to secure toughness. Thus, the upper limit of the amount of O is set to 0.0035% or less. In order to improve HAZ toughness, it is preferable to set the amount of O to 0.0015 or less. If the amount of O is set to less than 0.0003%, manufacturing costs increase. Thus, the amount of O is set to 0.0003% or more, preferably to 0.0005% or more. In order to suppress coarsening of crystalline grains of HAZ using the pinning effect resulting from oxide, it is preferable to set the amount of O to 0.0008% or more.

Nb: 0.020% to 0.070%

Nb is an element that increases hardenability, and it is necessary that the amount of Nb added is set to 0.020% or more. In order to improve strength, the amount of Nb is set to 0.026%, more preferably 0.030% or more. On the other hand, if the amount of Nb added exceeds 0.070%. Nb carbonitrides precipitate, possibly deteriorating toughness. Thus, the upper limit of the amount of Nb is set to 0.070% or less. In order to increase toughness, the amount of Nb is set preferably to 0.060% or less, or more preferably to 0.040% or less.

B: 0.0003% to 0.0010%

B increases hardenability with a small amount of B added, and forms a fine-grained bainite structure effective in improving toughness. Thus, it is necessary to set the amount of B contained to 0.0003% or more. However, if the amount of B contained exceeds 0.0010%, the island martensite forms, and the strength excessively increases, whereby the toughness significantly deteriorates, although a sufficient bainite structure can be obtained. Thus, the amount of B is set to 0.0010% or less. The upper limit of the amount of B is set preferably to 0.0008%, more preferably 0.0007%, and most preferably 0.0005%.

P: 0.010% or Less

S: 0.005% or Less

P and S, which are contained as inevitable impurities, cause weld cracking resulting from solidifying segregation, and a deterioration in toughness. Thus, P and S should be reduced as much as possible. The amount of P is limited to 0.010% or less, preferably 0.005% or less, more preferably 0.002% or less. Further, the amount of S is limited to 0.005% or less, preferably 0.003% or less. The lower limit value for each of P and S are not specifically limited, and it is only necessary that they are over 0%. However, considering the cost for reducing the lower limit values of P and S, it may be possible to set the lower limit of each of P and S to 0.0001% or more.

Further, in order to improve strength and toughness, and control a mode of inclusions, it may be possible to add at least one of V, Cu, Ni, Mo, Cr, Zr Hf, REM, Ca, and Mg. These elements are contained as selective elements, and hence, the lower limit value for each of the elements is not specifically limited, and is 0%.

V: 0.10% or Less

V contributes to precipitation strengthening through making the structure finer and with carbonitrides. To obtain this effect, it is preferable to set the amount of V added to 0.010% or more. However, the excessive amount of V added possibly leads to a deterioration in toughness. Thus, the upper limit of the amount of V is set to 0.10%.

Cu: 0.60% or Less

Cu is an element that improves hardenability, and contributes to strengthening the base metal through precipitation hardening. In order to cause a Cu to precipitate on dislocations of ferrite by maintaining temperatures during rolling in a range where ferrite forms and performing gradual cooling, and increase strength, it is preferable to add 0.04% or more of Cu. It is more preferable to add 0.10% or more of Cu. On the other hand, if the amount of Cu contained exceeds 0.60%, the strength excessively increases, possibly reducing low-temperature toughness. The upper limit of the amount of Cu is set more preferably to 0.40% or less.

Ni: 0.55% or Less

Ni is a significantly effective element since it increases strength and toughness of the base metal. In order to increase toughness, it is preferable to set the amount of Ni to 0.04% or more. More preferably, the amount of Ni added is set to 0.10% or more. On the other hand, adding 0.55% or more of Ni leads to an increase in alloying costs. More preferably, the upper limit of the amount of Ni is set to 0.40% or less.

Mo: 0.15% or Less

Mo is an element that dissolves in the steel to increase hardenability, and hence, contributes to improving strength. To obtain this effect, it is preferable to add 0.02% or more of Mo. However, if the amount of Mo contained exceeds 0.15%, Mo carbides ($Mo_2C$) precipitate, and the effect of increasing hardenability with solute Mo saturates. Thus, the upper limit of the amount of Mo is set to 0.15% or less.

Cr: 0.20% or Less

Cr is an element that increases hardenability, and contributes to improving strength. To obtain this effect, it is preferable to add 0.02% or more of Cr. However, if the amount of Cr added exceeds 0.20%, carbides form, possibly deteriorating toughness. Thus, the upper limit of the amount of Cr is set to 0.20% or less. The upper limit of the amount of Cr is set preferably to 0.10% or less.

Zr: 0.01% or Less

Hf: 0.01% or Less

Zr and Hf are deoxidizing elements that form nitrides at high temperatures. Adding Zr and/or Hf are effective in reducing the amount of solute N contained in the steel, and it is preferable to add 0.0005% or more of N. However, if Zr and/or Hf are excessively contained, nitrides coarsen, possibly deteriorating toughness. Thus, the amount of Zr is set to 0.01% or less, and the amount of Hf is set to 0.01% or less.

REM: 0.01% or Less

Ca: 0.005% or Less

Mg: 0.005% or Less

REM, Ca, and Mg are deoxidizing elements, and contribute to controlling modes of sulfides. Thus, it may be possible to add these elements. In order to obtain, for example, effects of making the structure finer through fine oxides, and suppressing coarsening of MnS, it is preferable to add at least one of the following elements: 0.0005% or more of REM; 0.0005% or more of Ca; and 0.0005% or more of Mg. However, oxide of REM, Ca, or Mg is more likely to move upward in the molten steel. Thus, by considering costs, the upper limit of REM in the steel is set to 0.01% or less, the upper limit of Ca is set to 0.005% or less, and the upper limit of Mg is set to 0.005% or less.

Balance: Fe and Inevitable Impurities

In the H-beam steel containing the elements described above, the balance, which mainly includes Fe, may contain impurities inevitably entering during, for example, manufacturing processes, within a range that does not compromise the characteristics of the present invention.

Next, the microstructure of the H-beam steel according to this embodiment will be described. The microstructure of the H-beam steel according to this embodiment mainly includes bainite having excellent strength and toughness, and is obtained by suppressing formation of pearlite and cementite that deteriorate toughness. Further, the remainder of the microstructure consists of island martensite and ferrite. Hereinafter, the symbol "%" in association with the microstructure means "area fraction" unless otherwise specified.

Bainite: 70% or More

Bainite contributes to increasing strength and making the structure finer. However, if the area fraction of bainite is less than 70%, the strength is not sufficient. Thus, the area fraction of bainite is set to 70% or more. In order to increase toughness, it is preferable to increase the area fraction of bainite. Thus, the upper limit is not set, and it may be possible to set the area fraction of bainite to 100%.

Further, in order to improve low-temperature toughness, it is necessary to make bainite finer. The upper limit of an effective crystalline-grain size is set to 40 μm or less. The effective crystalline-grain size represents the equivalent circle diameter of an area surrounded by a large-angle grain boundary having an orientation difference not less than 15°, and for example, an area of 550 μm×550 μm is measured with an electron backscatter diffraction pattern (EBSP). If the effective crystalline-grain size of bainite exceeds 40 μm, it is difficult to secure low-temperature toughness. The lower limit of the effective crystalline-grain size of bainite is not specified. However, it is difficult to make the steel finer, since the H-beam steels are rolled at high temperatures, and thus, the lower limit is usually set to 10 μm or more.

Pearlite+Cementite: 15% or Less

Pearlite and cementite serve as initiation points of fracture, and significantly deteriorate low-temperature toughness. Thus, the total of percentages of area of pearlite and cementite is limited to 15% or less. It is preferable that the percentages of area of pearlite and cementite are as low as possible, and it may be possible to set the percentages of area of pearlite and cementite to 0%.

Remainder: Island Martensite, Ferrite

The remainder, except for bainite, pearlite, and cementite, is island martensite, and ferrite. The island martensite serves as a start point of fracture, and deteriorates toughness. The area fraction of island martensite is not specifically set, but is desirable to be set as low as possible. The area fraction of microstructure is calculated as a ratio of the number of grains in each structure by using a photograph of structures taken with a magnification of ×200, arranging measurement points in a form of lattice with the length of a side of 50 μm, and distinguishing the structures at 300 measurement points.

The thickness of a flange of the H-beam steel is set in a range of 12 to 40 mm. This is because the H-beam steel used in a structure building at low temperatures commonly has a thickness in a range of 12 to 40 mm. As is the case with the flange, it is preferable that the thickness of a web is set in a range of 12 to 40 mm.

It should be noted that it is preferable to set the ratio of thickness between the flange and the web (the ratio of flange/web in thickness) in a range of 0.5 to 2.0 on the assumption that the H-beam steel is manufactured through hot rolling. If the ratio of flange/web in thickness exceeds 2.0, the web may deform in a wavy shape. On the other hand, if the ratio of flange/web in thickness is less than 0.5, the flange may deform in a wavy shape.

As for the target value of strength, the yield point or 0.2% proof strength at ordinary temperatures is set to 345 MPa or more, and the tensile strength is set to 460 to 620 MPa. Charpy impact absorbing energies at −40° C. and −50° C. are 60 J or more and 26 J or more, respectively, at the base metal portion. The CTOD values at −10° C. are set to 0.15 mm or more to rationally guarantee the low-temperature toughness.

In particular, manufacturing an H-beam steel having strength and toughness is more difficult than manufacturing steel sheet having strength and toughness. This is because, when an ultra-thick H-beam steel is manufactured from a slab or a row material having a beam blank shape, it is difficult to secure the amount of working at the fillet portion (portion where the flange and the web are jointed) as well as at the flange.

Next, the method of manufacturing the H-beam steel according to an embodiment of the present invention will be described.

In steel-manufacturing processes, chemical components in the molten steel are adjusted as described above, and then, casting is performed to obtain blooms. For casting, it is preferable to employ continuous casting from the viewpoint of productivity. Further, it is preferable to set the thickness of the bloom to 200 mm or more from the viewpoint of productivity. By considering a reduction in segregation, and uniformity in heating temperatures during hot rolling, it is preferable to set the thickness of the bloom to 350 mm or less.

Next, the bloom is heated, and hot rolling is performed. The heating temperatures to the bloom are not specifically set, but are set preferably in the range of 1100 to 1350° C. If the heating temperature is lower than 1100° C. the resistance to deformation increases. In order to sufficiently dissolve elements such as Nb that form carbides and nitrides, it is preferable to set the lower limit of the reheating temperatures to 1150° C. or higher. In particular, in the case where the thickness is thin, the cumulative rolling reduction increases, and hence, it is preferable to heat to 1200° C. or higher. On the other hand, in the case where the heating temperatures are set to high temperatures higher than 1350° C. scales on the surface of the bloom, which is a raw material, liquefy, and the inside of the heating furnace may be damaged. In order to suppress coarsening of the structures, it is preferable to set the upper limit of the heating temperatures to 1300° C. or lower.

During finishing rolling in the hot rolling, controlled rolling is performed. Controlled rolling is a manufacturing method in which rolling temperatures and rolling reduction are controlled. In finishing rolling, it is preferable that water-cooling rolling between passes is performed for one or more passes. The water-cooling rolling between passes is a manufacturing method in which water cooling is performed and rolling is performed during a reheating process. It is more preferable to apply thermal treatment after finishing rolling. Further, it may be possible to employ a so-called two-heat rolling, which is a manufacturing process in which the first rolling is performed, then temperatures are decreased to 500° C. or lower, temperatures are increased again to 1100 to 1350° C., and then, the second rolling is performed. With the two-heat rolling, the amount of plastic deformation is small during hot rolling, and a reduction in temperatures is small during rolling processes. Thus, it is possible to set the heating temperatures to be lower.

For the finishing rolling of hot rolling, it is necessary to, after the bloom is heated, perform rolling for one or more passes with surface temperatures of the flange being set in the range of 770 to 870° C. This is because, through hot rolling, recrystallization by working is facilitated, and austenite is made fine-grained, thereby improving toughness and strength. If the temperatures during finishing rolling are excessively higher, it is difficult to reduce the size of crystalline grains, and hence, the upper limit of the temperatures is set to 870° C. or lower. On the other hand, if the temperatures during finishing rolling are excessively lower, ferrite, which has been formed through transformation, is rolled, possibly deteriorating toughness. Thus, the lower limit of the temperatures is set to 770° C. or higher. Note that it may be possible to perform rough rolling before finishing rolling depending on the thickness of the bloom and the thickness of the product.

During finishing rolling, it is preferable that the water-cooling rolling between passes is performed for one or more passes. The water-cooling rolling between passes is a method of rolling in which surface temperatures of the flange are cooled to 700° C. or lower, and then, rolling is performed during a reheating process. The water-cooling rolling between passes is a method of rolling in which, by performing water cooling between rolling passes, temperatures are made different between the surface layer portion of the flange and the inside of the flange. During water-cooling rolling between passes, it is possible to introduce work strain into the inside of the plate in the thickness direction even if rolling reduction is small. Further, by decreasing the rolling temperatures within a short period of time through water cooling, productivity can be improved.

It may be possible to, after the average temperature of the flange is cooled to 400° C. or lower, reheat it at temperatures in the range of 400 to 500° C. By reheating to the temperatures in the range of 400 to 500° C., it is possible to decompose the island martensite existing in the microstructure without applying any process after rolling finishes. In order to diffuse, into a matrix, C existing in the island martensite, it is preferable to set the heating temperature to 400° C. or higher, and set the maintaining time to 15 minutes or longer. The upper limit of the heating temperature and the upper limit of the maintaining time are not specifically set. However, from the viewpoint of manufacturing cost, it is preferable to set the upper limit of the heating temperature to 500° C. or lower, and set the upper limit of the maintaining time to five hours or shorter. Reheating after cooling can be performed in a thermal treatment furnace.

Examples

Steels containing components shown in Table 3 and Table 4 were smelted, and continuous casting was performed to manufacture steel pieces each having a thickness in the range of 240 to 300 mm. Smelting the steels was performed with a converter. Primary deoxidation was performed. Alloys were added to adjust the components. Further, vacuum degassing processes were performed depending on applications. The steel pieces thus obtained were heated, and hot rolling was performed, thereby manufacturing H-beam steels. The components shown in Table 3 and Table 4 were obtained through chemical analysis on samples taken from the H-beam steels after manufacturing. Note that the steel No. AP in Table 3 is an H-beam steel having a flange with a large thickness and containing components whose amounts falls within the range of the present invention.

TABLE 3

| Steel | Components (mass %) | | | | | | | | | |
|---|---|---|---|---|---|---|---|---|---|---|
| No. | C | Si | Mn | Al | Ti | N | O | P | S | Note |
| A | 0.014 | 0.20 | 1.82 | 0.016 | 0.020 | 0.0042 | 0.0009 | 0.009 | 0.003 | Steel according to |
| B | 0.015 | 0.20 | 1.65 | 0.007 | 0.020 | 0.0036 | 0.0024 | 0.009 | 0.003 | present invention |
| C | 0.040 | 0.20 | 1.65 | 0.016 | 0.020 | 0.0040 | 0.0010 | 0.009 | 0.003 | |
| D | 0.015 | 0.06 | 1.98 | 0.020 | 0.021 | 0.0041 | 0.0030 | 0.009 | 0.003 | |
| E | 0.013 | 0.46 | 0.81 | 0.010 | 0.019 | 0.0041 | 0.0009 | 0.009 | 0.003 | |
| F | 0.040 | 0.20 | 0.84 | 0.016 | 0.020 | 0.0038 | 0.0010 | 0.009 | 0.003 | |
| G | 0.013 | 0.21 | 0.83 | 0.015 | 0.021 | 0.0040 | 0.0011 | 0.009 | 0.003 | |
| H | 0.012 | 0.20 | 0.83 | 0.016 | 0.020 | 0.0040 | 0.0010 | 0.009 | 0.002 | |
| I | 0.014 | 0.28 | 1.85 | 0.006 | 0.024 | 0.0030 | 0.0028 | 0.009 | 0.003 | |
| J | 0.015 | 0.14 | 1.70 | 0.037 | 0.015 | 0.0025 | 0.0009 | 0.008 | 0.003 | |
| K | 0.013 | 0.23 | 0.86 | 0.017 | 0.006 | 0.0044 | 0.0025 | 0.009 | 0.003 | |
| L | 0.016 | 0.20 | 0.80 | 0.015 | 0.024 | 0.0039 | 0.0009 | 0.009 | 0.003 | |
| M | 0.020 | 0.24 | 1.90 | 0.016 | 0.020 | 0.0043 | 0.0010 | 0.009 | 0.003 | |
| N | 0.012 | 0.19 | 1.80 | 0.015 | 0.019 | 0.0040 | 0.0009 | 0.009 | 0.003 | |
| O | 0.015 | 0.20 | 1.86 | 0.015 | 0.019 | 0.0014 | 0.0010 | 0.009 | 0.002 | |
| P | 0.013 | 0.20 | 1.82 | 0.020 | 0.025 | 0.0080 | 0.0009 | 0.009 | 0.003 | |
| Q | 0.014 | 0.19 | 1.80 | 0.014 | 0.019 | 0.0045 | 0.0003 | 0.009 | 0.003 | |
| R | 0.012 | 0.22 | 1.92 | 0.026 | 0.025 | 0.0030 | 0.0030 | 0.009 | 0.003 | |
| S | 0.012 | 0.19 | 1.81 | 0.015 | 0.020 | 0.0070 | 0.0029 | 0.009 | 0.003 | |
| T | 0.012 | 0.20 | 1.78 | 0.015 | 0.020 | 0.0034 | 0.0009 | 0.009 | 0.003 | |
| U | 0.011 | 0.20 | 1.65 | 0.015 | 0.020 | 0.0039 | 0.0009 | 0.009 | 0.003 | |
| V | 0.014 | 0.20 | 1.82 | 0.016 | 0.020 | 0.0042 | 0.0009 | 0.009 | 0.003 | |
| W | 0.014 | 0.19 | 1.80 | 0.014 | 0.013 | 0.0044 | 0.0009 | 0.009 | 0.003 | |
| X | 0.014 | 0.19 | 1.80 | 0.014 | 0.013 | 0.0044 | 0.0010 | 0.009 | 0.003 | |
| Y | 0.013 | 0.19 | 1.80 | 0.014 | 0.013 | 0.0044 | 0.0009 | 0.009 | 0.003 | |
| Z | 0.014 | 0.19 | 1.81 | 0.014 | 0.013 | 0.0039 | 0.0009 | 0.009 | 0.003 | |
| AA | 0.014 | 0.19 | 1.80 | 0.014 | 0.013 | 0.0044 | 0.0009 | 0.009 | 0.003 | |
| AP | 0.013 | 0.20 | 1.82 | 0.016 | 0.020 | 0.0042 | 0.0009 | 0.009 | 0.003 | |
| AB | 0.060 | 0.20 | 1.82 | 0.016 | 0.020 | 0.0041 | 0.0009 | 0.009 | 0.003 | Comparative steel |
| AC | 0.013 | 0.56 | 1.82 | 0.016 | 0.021 | 0.0040 | 0.0010 | 0.009 | 0.003 | |
| AD | 0.013 | 0.20 | 2.21 | 0.016 | 0.020 | 0.0042 | 0.0009 | 0.009 | 0.003 | |
| AE | 0.013 | 0.20 | 1.82 | 0.016 | 0.020 | 0.0042 | 0.0009 | 0.010 | 0.003 | |
| AF | 0.012 | 0.20 | 1.82 | 0.004 | 0.020 | 0.0042 | 0.0011 | 0.009 | 0.003 | |
| AG | 0.013 | 0.21 | 1.82 | 0.060 | 0.020 | 0.0042 | 0.0009 | 0.008 | 0.003 | |
| AH | 0.013 | 0.20 | 1.83 | 0.016 | 0.005 | 0.0042 | 0.0012 | 0.009 | 0.003 | |
| AI | 0.013 | 0.20 | 1.82 | 0.016 | 0.031 | 0.0042 | 0.0009 | 0.009 | 0.003 | |
| AJ | 0.013 | 0.20 | 1.82 | 0.016 | 0.020 | 0.0042 | 0.0012 | 0.009 | 0.004 | |
| AK | 0.013 | 0.22 | 1.82 | 0.016 | 0.020 | 0.0101 | 0.0009 | 0.009 | 0.003 | |
| AL | 0.013 | 0.20 | 1.82 | 0.015 | 0.020 | 0.0042 | 0.0042 | 0.009 | 0.003 | |
| AM | 0.013 | 0.20 | 1.82 | 0.016 | 0.020 | 0.0042 | 0.0011 | 0.010 | 0.003 | |
| AN | 0.014 | 0.20 | 1.82 | 0.016 | 0.022 | 0.0044 | 0.0009 | 0.009 | 0.003 | |
| AO | 0.013 | 0.20 | 1.82 | 0.016 | 0.020 | 0.0042 | 0.0009 | 0.009 | 0.003 | |

Underlines indicate that values tall outside the range of the present invention.

TABLE 4

| Steel | Components (mass %) (balance: Fe and inevitable impurities) | | | | | | | | | | |
|---|---|---|---|---|---|---|---|---|---|---|---|
| No. | Nb | B | V | Cu | Ni | Mo | Cr | Zr, Hf | REM, Ca, Mg | Nb + 125B | Note |
| A | 0.040 | 0.0004 | | | | | | | | 0.090 | Steel according to |
| B | 0.040 | 0.0004 | | | | 0.08 | | | | 0.090 | present invention |
| C | 0.040 | 0.0004 | | | | | | | | 0.090 | |
| D | 0.040 | 0.0005 | | | | | | | | 0.103 | |
| E | 0.040 | 0.0004 | | | | | | | | 0.090 | |
| F | 0.050 | 0.0005 | | | | | | | | 0.113 | |
| G | 0.030 | 0.0004 | | 0.57 | | | | | | 0.080 | |
| H | 0.040 | 0.0004 | | | 0.54 | | | | | 0.090 | |
| I | 0.050 | 0.0005 | | | | | | | | 0.113 | |
| J | 0.040 | 0.0004 | | | | | | | | 0.090 | |

TABLE 4-continued

| Steel | Components (mass %) (balance: Fe and inevitable impurities) | | | | | | | | | | |
|---|---|---|---|---|---|---|---|---|---|---|---|
| No. | Nb | B | V | Cu | Ni | Mo | Cr | Zr, Hf | REM, Ca, Mg | Nb + 125B | Note |
| K | 0.040 | 0.0005 | | | | | | | | 0.103 | |
| L | 0.040 | 0.0004 | | | | | | | | 0.090 | |
| M | 0.026 | 0.0005 | | | | | | | | 0.089 | |
| N | 0.070 | 0.0004 | | | | | | | | 0.120 | |
| O | 0.040 | 0.0004 | | | | | | | | 0.090 | |
| P | 0.030 | 0.0005 | | | | | | | | 0.093 | |
| Q | 0.040 | 0.0004 | | | | | | | | 0.090 | |
| R | 0.040 | 0.0005 | | | | | | | | 0.103 | |
| S | 0.030 | 0.0010 | | | | | | | | 0.155 | |
| T | 0.020 | 0.0005 | 0.06 | | | | | | | 0.083 | |
| U | 0.030 | 0.0004 | | | | 0.15 | | | | 0.080 | |
| V | 0.040 | 0.0004 | | | | | 0.18 | | | 0.090 | |
| W | 0.040 | 0.0004 | | | | | | | Mg: 0.004 | 0.090 | |
| X | 0.040 | 0.0004 | | | | | | Zr: 0.01 | | 0.090 | |
| Y | 0.040 | 0.0004 | | | | | | Hf: 0.006 | | 0.090 | |
| Z | 0.040 | 0.0004 | | | | | | | REM: 0.007 | 0.090 | |
| AA | 0.040 | 0.0004 | | | | | | | Ca: 0.003 | 0.090 | |
| AP | 0.040 | 0.0004 | | | | | | | | 0.090 | |
| AB | 0.040 | 0.0004 | | | | | | | | 0.090 | Comparative steel |
| AC | 0.040 | 0.0005 | | | | | | | | 0.103 | |
| AD | 0.040 | 0.0004 | | | | | | | | 0.090 | |
| AE | 0.040 | 0.0004 | | 0.81 | | | | | | 0.090 | |
| AF | 0.040 | 0.0004 | | | | | | | | 0.090 | |
| AG | 0.040 | 0.0004 | | | | | | | | 0.090 | |
| AH | 0.040 | 0.0004 | | | | | | | | 0.090 | |
| AI | 0.040 | 0.0004 | | | | | | | | 0.090 | |
| AJ | 0.090 | 0.0004 | | | | | | | | 0.140 | |
| AK | 0.040 | 0.0004 | | | | | | | | 0.090 | |
| AL | 0.040 | 0.0004 | | | | | | | | 0.090 | |
| AM | 0.058 | 0.0002 | | | | | | | | 0.083 | |
| AN | 0.026 | 0.0013 | | | | | | | | 0.189 | |
| AO | 0.010 | 0.0004 | | | | | | | | 0.060 | |

Blank cells indicate that elements are intentionally not added.
Underlines indicate that values fall outside the range of the present invention.

FIG. 1 shows processes of manufacturing an H-beam steel. The steel pieces heated in a heating furnace were hot rolled with a series of universal rolling units. In the case where water-cooling rolling between passes is employed for hot rolling, water cooling was performed between rolling passes using water cooling devices 2*a* provided before and after an intermediate universal rolling mill (intermediate rolling mill) 1, spray cooling was performed to surfaces on the external side of the flange, and reverse rolling was performed. Controlled cooling after controlled rolling was performed in a manner such that, after finishing rolling was completed with a finishing universal rolling mill (finish rolling mill) 3, the surfaces on the external side of the flange were water cooled with a cooling device (water cooling device) 2*b* provided on the rear face. Table 5 shows manufacturing conditions.

TABLE 5

| | Steel No. | Heating temperature (° C.) | Finishing rolling temperature (° C.) | Flange thickness (mm) | Note |
|---|---|---|---|---|---|
| Example 1 | A | 1300 | 870 | 40 | Example |
| Example 2 | B | 1300 | 850 | 25 | |
| Example 3 | C | 1300 | 850 | 25 | |
| Example 4 | D | 1300 | 850 | 25 | |
| Example 5 | E | 1300 | 850 | 25 | |
| Example 6 | F | 1300 | 850 | 25 | |
| Example 7 | G | 1300 | 850 | 25 | |
| Example 8 | H | 1300 | 850 | 25 | |
| Example 9 | I | 1300 | 850 | 25 | |
| Example 10 | J | 1300 | 850 | 25 | |
| Example 11 | K | 1300 | 850 | 25 | |
| Example 12 | L | 1300 | 850 | 25 | |
| Example 13 | M | 1300 | 850 | 25 | |
| Example 14 | N | 1300 | 850 | 25 | |
| Example 15 | O | 1300 | 850 | 25 | |
| Example 16 | P | 1300 | 850 | 25 | |
| Example 17 | Q | 1300 | 850 | 25 | |
| Example 18 | R | 1300 | 850 | 25 | |
| Example 19 | S | 1300 | 850 | 25 | |
| Example 20 | T | 1300 | 850 | 25 | |
| Example 21 | U | 1300 | 850 | 25 | |
| Example 22 | V | 1300 | 850 | 25 | |

TABLE 5-continued

| | Steel No. | Heating temperature (° C.) | Finishing rolling temperature (° C.) | Flange thickness (mm) | Note |
|---|---|---|---|---|---|
| Example 23 | W | 1300 | 850 | 25 | |
| Example 24 | X | 1300 | 850 | 25 | |
| Example 25 | Y | 1300 | 850 | 25 | |
| Example 26 | Z | 1300 | 850 | 25 | |
| Example 27 | AA | 1300 | 850 | 25 | |
| Example 28 | A | 1300 | 790 | 12 | |
| Comparative Example 29 | AB | 1300 | 850 | 25 | Comparative Example |
| Comparative Example 30 | AC | 1300 | 850 | 25 | |
| Comparative Example 31 | AD | 1300 | 850 | 25 | |
| Comparative Example 32 | AE | 1300 | 850 | 25 | |
| Comparative Example 33 | AF | 1300 | 850 | 25 | |
| Comparative Example 34 | AG | 1300 | 850 | 25 | |
| Comparative Example 35 | AH | 1300 | 850 | 25 | |
| Comparative Example 36 | AI | 1300 | 850 | 25 | |
| Comparative Example 37 | AJ | 1300 | 850 | 25 | |
| Comparative Example 38 | AK | 1300 | 850 | 25 | |
| Comparative Example 39 | AL | 1300 | 850 | 25 | |
| Comparative Example 40 | AM | 1300 | 850 | 25 | |
| Comparative Example 41 | AN | 1300 | 850 | 25 | |
| Comparative Example 42 | AO | 1300 | 850 | 25 | |
| Comparative Example 43 | AP | 1300 | 850 | 45 | |
| Comparative Example 44 | A | 1300 | 930 | 40 | |

Underlines indicate that values fall outside the range or the present invention.

Figure 2:
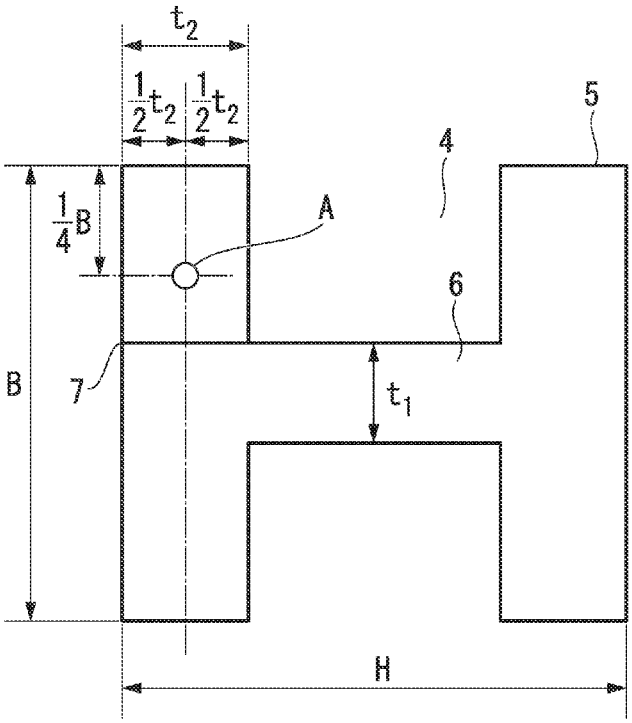
FIG. 2 is a diagram for explaining a position where a test piece is taken.

FIG. 2 is a diagram for explaining a test-piece taking position A. As illustrated in FIG. 2, the test-piece taking position A is located in the center of the plate thickness $t_2$ of a flange 5 of an H-beam steel 4 ($\frac{1}{2}t_2$) and at a portion ¼B, which is located at a quarter of the entire length B of the flange width. Test pieces were taken from this test-piece taking position A, and mechanical properties thereof were measured. The reference character $t_1$ represents the thickness of a web, and the reference character H represents the height. Note that the properties at the test-piece taking position A illustrated in FIG. 2 are judged to represent average mechanical properties of the H-beam steel, and hence, properties were measured at this position. Tensile tests were performed in accordance with JIS Z 2241 (2011). If the sample showed yielding behavior, the yield point was obtained as YS. If the samples did not show yielding behavior, the 0.2% proof strength was obtained as YS. Charpy impact test was done at 0° C. and in accordance with JIS Z 2242 (2011). Test pieces for CTOD were prepared by taking out the entire thickness of a flange portion, manufacturing, flat and smooth test pieces, and setting the position of a notch on the extended line drawn from the original web surface.

Further, samples were taken from the position where the test pieces used for measuring the mechanical properties were taken, and metal structures were observed with an optical microscope to measure the total of the area fraction of bainite and the percentages of area of pearlite and cementite. Yet further, with EBSP, the effective crystalline-grain size of bainite was obtained.

The results are shown in Table 6 and Table 7. In Table 6. YS represents the yield point or 0.2% proof strength at normal room temperatures. The target values of the mechanical properties are as follows: yield point or 0.2 proof strength is 345 MPa or more at normal temperatures: tensile strength is in the range of 460 to 620 MPa; Charpy impact absorbing energies at −40° C. and −50° C. are 60 J or more, and 26 J or more, respectively; and CTOD values at −10° C. are 0.15 mm or more.

TABLE 6

| | Steel No. | Bainite (%) | Grain size (μm) | Pearlite + Cementite (%) | Remainder of structure (%) | Remainder of structure Type | Main structure of remainder |
|---|---|---|---|---|---|---|---|
| Example 1 | A | 95 | 30 | 5 | 0 | — | — |
| Example 2 | B | 90 | 15 | 3 | 7 | F, MA | F |
| Example 3 | C | 85 | 17 | 13 | 2 | F, MA | MA |
| Example 4 | D | 80 | 20 | 12 | 8 | F, MA | F |
| Example 5 | E | 90 | 14 | 7 | 3 | F, MA | MA |
| Example 6 | F | 76 | 21 | 13 | 11 | F, MA | F |
| Example 7 | G | 90 | 16 | 7 | 3 | F, MA | MA |
| Example 8 | H | 91 | 14 | 6 | 3 | F, MA | MA |
| Example 9 | I | 80 | 21 | 5 | 15 | F, MA | F |
| Example 10 | J | 91 | 19 | 6 | 3 | F, MA | MA |
| Example 11 | K | 84 | 22 | 4 | 12 | F, MA | F |
| Example 12 | L | 83 | 18 | 5 | 12 | F, MA | F |
| Example 13 | M | 80 | 23 | 12 | 8 | F, MA | F |
| Example 14 | N | 95 | 16 | 3 | 2 | F, MA | MA |
| Example 15 | O | 85 | 20 | 5 | 10 | F, MA | F |
| Example 16 | P | 80 | 28 | 6 | 14 | F, MA | F |
| Example 17 | Q | 92 | 15 | 5 | 3 | F, MA | F |

TABLE 6-continued

| | Steel No. | Bainite (%) | Grain size (μm) | Pearlite + Cementite (%) | Remainder of structure (%) | Remainder of structure Type | Main structure of remainder |
|---|---|---|---|---|---|---|---|
| Example 18 | R | 90 | 18 | 4 | 6 | F, MA | F |
| Example 19 | S | 95 | 14 | 3 | 2 | F, MA | MA |
| Example 20 | T | 93 | 14 | 3 | 4 | F, MA | F |
| Example 21 | U | 91 | 13 | 3 | 6 | F, MA | F |
| Example 22 | V | 95 | 13 | 5 | 0 | — | — |
| Example 23 | W | 80 | 14 | 5 | 15 | F, MA | F |
| Example 24 | X | 92 | 14 | 7 | 1 | F, MA | F |
| Example 25 | Y | 85 | 13 | 5 | 10 | F, MA | F |
| Example 26 | Z | 90 | 13 | 4 | 6 | F, MA | F |
| Example 27 | AA | 85 | 14 | 5 | 10 | F, MA | F |
| Example 28 | A | 73 | 14 | 14 | 13 | F, MA | F |
| Comparative Example 29 | AB | 80 | 15 | 17 | 3 | F, MA | MA |
| Comparative Example 30 | AC | 75 | 16 | 5 | 20 | F, MA | MA |
| Comparative Example 31 | AD | 85 | 14 | 5 | 10 | F, MA | MA |
| Comparative Example 32 | AE | 87 | 15 | 5 | 8 | F, MA | MA |
| Comparative Example 33 | AF | 82 | 38 | 4 | 14 | F, MA | F |
| Comparative Example 34 | AG | 83 | 15 | 5 | 12 | F, MA | MA |
| Comparative Example 35 | AH | 85 | 43 | 10 | 5 | F, MA | F |
| Comparative Example 36 | AI | 90 | 14 | 3 | 7 | F, MA | F |
| Comparative Example 37 | AJ | 95 | 14 | 2 | 3 | F, MA | MA |
| Comparative Example 38 | AK | 74 | 13 | 15 | 11 | F, MA | F |
| Comparative Example 39 | AL | 74 | 14 | 13 | 13 | F, MA | F |
| Comparative Example 40 | AM | 68 | 37 | 14 | 18 | F, MA | F |
| Comparative Example 41 | AN | 77 | 15 | 2 | 21 | F, MA | MA |
| Comparative Example 42 | AO | 76 | 13 | 17 | 7 | F, MA | F |
| Comparative Example 43 | AP | 87 | 65 | 2 | 11 | F, MA | F |
| Comparative Example 44 | A | 85 | 57 | 14 | 1 | F, MA | MA |

In structure, F represents territe, and MA represents island martensite.
Underlines indicate that values fall outside the range of the present invention.

TABLE 7

| | YS (MPa) | TS (MPa) | $vE_{-40}$ (J) | $vE_{-50}$ (J) | CTOD value (mm) |
|---|---|---|---|---|---|
| Example 1 | 409 | 517 | 393 | 380 | 0.51 |
| Example 2 | 425 | 512 | 392 | 381 | 0.68 |
| Example 3 | 405 | 514 | 395 | 377 | 0.52 |
| Example 4 | 444 | 562 | 350 | 333 | 0.3 |
| Example 5 | 346 | 461 | 399 | 381 | 0.55 |
| Example 6 | 346 | 461 | 398 | 387 | 0.6 |
| Example 7 | 347 | 462 | 398 | 361 | 0.51 |
| Example 8 | 346 | 462 | 397 | 310 | 0.49 |
| Example 9 | 514 | 530 | 298 | 196 | 0.34 |
| Example 10 | 385 | 488 | 390 | 377 | 0.44 |
| Example 11 | 346 | 461 | 395 | 310 | 0.5 |
| Example 12 | 346 | 466 | 396 | 351 | 0.59 |
| Example 13 | 434 | 549 | 269 | 201 | 0.29 |
| Example 14 | 403 | 510 | 393 | 208 | 0.56 |
| Example 15 | 419 | 531 | 297 | 198 | 0.28 |
| Example 16 | 410 | 515 | 392 | 311 | 0.47 |
| Example 17 | 405 | 516 | 393 | 292 | 0.53 |
| Example 18 | 430 | 543 | 285 | 158 | 0.41 |
| Example 19 | 405 | 514 | 394 | 325 | 0.4 |
| Example 20 | 413 | 529 | 274 | 127 | 0.28 |
| Example 21 | 418 | 520 | 281 | 159 | 0.29 |
| Example 22 | 422 | 541 | 385 | 321 | 0.44 |
| Example 23 | 404 | 520 | 269 | 188 | 0.31 |
| Example 24 | 409 | 515 | 396 | 368 | 0.44 |
| Example 25 | 418 | 518 | 291 | 185 | 0.35 |
| Example 26 | 407 | 514 | 395 | 341 | 0.39 |
| Example 27 | 406 | 519 | 285 | 183 | 0.39 |
| Example 28 | 418 | 521 | 88 | 26 | 0.15 |
| Comparative Example 29 | 468 | 599 | 51 | 30 | 0.1 |
| Comparative Example 30 | 407 | 520 | 50 | 31 | 0.11 |
| Comparative Example 31 | 492 | 623 | 55 | 28 | 0.13 |
| Comparative Example 32 | 475 | 621 | 65 | 19 | 0.20 |
| Comparative Example 33 | 402 | 514 | 41 | 27 | 0.18 |
| Comparative Example 34 | 405 | 515 | 50 | 30 | 0.11 |
| Comparative Example 35 | 409 | 520 | 45 | 21 | 0.14 |
| Comparative Example 36 | 471 | 599 | 48 | 20 | 0.19 |

TABLE 7-continued

| | YS (MPa) | TS (MPa) | $vE_{-40}$ (J) | $vE_{-50}$ (J) | CTOD value (mm) |
|---|---|---|---|---|---|
| Comparative Example 37 | 470 | 612 | 90 | 24 | 0.23 |
| Comparative Example 38 | 411 | 517 | 57 | 50 | 0.12 |
| Comparative Example 39 | 412 | 515 | 54 | 51 | 0.21 |
| Comparative Example 40 | 340 | 455 | 80 | 21 | 0.22 |
| Comparative Example 41 | 440 | 619 | 78 | 19 | 0.19 |
| Comparative Example 42 | 407 | 520 | 58 | 33 | 0.18 |
| Comparative Example 43 | 420 | 539 | 57 | 21 | 0.11 |
| Comparative Example 44 | 411 | 520 | 51 | 30 | 0.22 |

As shown in Table 6, Examples 1 to 28 according to the present invention have high 0.2% proof strength and tensile strength at normal temperatures, and sufficiently achieve the targets of Charpy impact absorbing energy at −40° C. and −50° C. and CTOD values at −10° C.

On the other hand, Comparative Example 29 is an example that contains the excessive amount of C, and has increased carbides, increased pearlite and cementite, and deteriorated toughness. Comparative Example 30 is an example that contains the excessive amount of Si, in which island martensite forms, and toughness deteriorates. Comparative Example 31 contains the excessive amount of Mn, and Comparative Example 32 contains the excessive amount of Cu, which are examples having increased strength and deteriorated toughness. Comparative Example 33 contains insufficient amount of Al, in which deoxidation is not sufficient. Comparative Example 34 is an example that contains the excessive amount of Al, and has increased amount of oxide, and reduced toughness. Comparative Example 35 contains insufficient amount of Ti, in which the structure is not sufficiently made finer. Comparative Example 36 is an example that contains the excessive amount of Ti, in which coarsened TiN is formed, and the toughness is deteriorated.

Comparative Example 37 is an example that contains the excessive amount of Nb, and has increased precipitates and reduced toughness. Comparative Example 38 is an example that has the excessive amount of N, in which coarsened nitrides are formed, and the toughness deteriorates. Comparative Example 39 is an example that contains the excessive amount of O, in which clusters of oxide are generated, and the toughness deteriorates. Comparative Example 40 is an example that contains insufficient amount of B, in which formation of bainite is not sufficient, and the strength and the toughness are deteriorated. Comparative Example 41 is an example that contains the excessive amount of B, has increased strength and increased island martensite, and has deteriorated toughness.

Further, Comparative Example 42 is an example having the amount of Nb and the amount of B that do not satisfy the equation Nb+125B≥0.070, in which carbides are formed, and the toughness is not sufficient. Comparative Example 43 has an excessive thickness, rolling is not sufficiently applied, the structure is coarsened, and the toughness is not sufficient. For Comparative Example 44, rolling temperature are excessively high, the structure is coarsened, and the toughness is not sufficient.

INDUSTRIAL APPLICABILITY

According to the present invention, it is possible to manufacture the high-strength H-beam steel exhibiting low-temperature toughness without applying accelerated cooling after rolling finishes. This makes it possible to achieve a reduction in manufacturing times, and significantly reduce the cost. Thus, reliability of large buildings can be enhanced without sacrificing cost efficiency, and hence, the present invention makes an extremely significant contribution to industries.

BRIEF DESCRIPTION OF THE REFERENCE SYMBOLS

1 Intermediate rolling mill
2*a* Water cooling device on front and rear surfaces of intermediate rolling mill
2*b* Cooling device on rear surface of finish rolling mill
3 Finish rolling mill
4 H-beam steel
5 Flange
6 Web
7 Notch position for CTOD
B Entire length of flange width
H Height
$t_1$ Thickness of web
$t_2$ Thickness of flange
A Test-piece taking position

The invention claimed is:

1. An H-beam steel with a composition comprising, in mass %:
C: 0.011 to 0.020%;
Si: 0.06 to 0.50%;
Mn: 0.80 to 1.98%;
Al: 0.006 to 0.040%;
Ti: 0.006 to 0.025%;
N: 0.001 to 0.009%;
O: 0.0003 to 0.0035%;
Nb: 0.020 to 0.070%;
B: 0.0003 to 0.0010%;
P: limited to not more than 0.010%; and
S: limited to not more than 0.005%,
with a balance including Fe and inevitable impurities, wherein
an amount of Nb and an amount of B satisfy, in mass %, the following Equation (1):

$$0.070 \leq Nb+125B \leq 0.155,$$

the H-beam steel has a metal structure in which, in a microstructure, an area fraction of bainite is not less than 70%, a total of an area fraction of pearlite and an area fraction of cementite is not more than 15%, and the remainder consists of at least one of ferrite or island martensite,
an effective crystalline-grain size, which represents an equivalent circle diameter of an area surrounded by a large-angle grain boundary having an orientation difference not less than 15°, of the bainite is 21 to 40 μM, and
a thickness of a flange falls in a range of 12 to 40 mm.

2. The H-beam steel according to claim 1, wherein
the composition further comprises, in mass %, at least one of:
V: not more than 0.10%;
Cu: not more than 0.60%;
Ni: not more than 0.55%;
Mo: not more than 0.15%; or
Cr: not more than 0.20%.

3. The H-beam steel according to claim 1, wherein the composition further comprises, in mass %, at least one of:
Zr: not more than 0.01%; or
Hf: not more than 0.01%.

4. The H-beam steel according to claim 1, wherein the composition further comprises, in mass %, at least one of:
REM: not more than 0.01%;
Ca: not more than 0.005%; or
Mg: not more than 0.005%.

5. The H-beam steel according to claim 1, wherein the composition further comprises, in mass %, at least one of:
V: not more than 0.10%;
Cu: not more than 0.60%;
Ni: not more than 0.55%;
Mo: not more than 0.15%;
Cr: not more than 0.20%;
Zr: not more than 0.01%;
Hf: not more than 0.01%;
REM: not more than 0.01%;
Ca: not more than 0.005%; or
Mg: not more than 0.005%.

6. The H-beam steel according to claim 1, wherein
the amount of Nb and the amount of B satisfy, in mass %, the following Equation (2):

$$0.070 \leq Nb+125B \leq 0.115.$$

* * * * *